United States Patent [19]

Di Liberto et al.

[11] 4,122,558

[45] Oct. 31, 1978

[54] WATER SHOWER UNIT

[76] Inventors: Menno Di Liberto, 45 Canterbury Dr., Athens, Ohio 47501; Joseph P. Parisi, 87-60 97th St., Woodhaven, N.Y. 11421

[21] Appl. No.: 753,637

[22] Filed: Dec. 23, 1976

[51] Int. Cl.[2] ..... A47K 3/22

[52] U.S. Cl. ..... 4/145; 4/148

[58] Field of Search ..... 4/145, 151, 152, 153, 4/154, 155, 156, 147, 146, 148, 149; 239/282, 567, 537, 538, 564, 563, 562

[56] References Cited

U.S. PATENT DOCUMENTS

| | | | |
|---|---|---|---|
| 3,375,533 | 4/1968 | Lucian | 4/145 |
| 3,458,874 | 8/1969 | Fritz | 4/145 |
| 3,724,760 | 4/1973 | Smith | 4/145 X |
| 3,858,252 | 1/1975 | Ejchorszt | 4/145 |
| 3,984,879 | 10/1976 | Ejchorszt | 4/145 |

*Primary Examiner*—Henry K. Artis

*Attorney, Agent, or Firm*—Jeremiah J. Duggan

[57] ABSTRACT

A water shower assembly is formed of unitized plastic members. A plurality of dispersing nozzles are integrally formed in a panel member to provide a desired shower pattern. A plenum is formed about the plurality of nozzles to provide appropriate water supply thereto. Open channel means are sealingly connected to the panel member forming a conduit for conveying water from a supply main to the plenum and a valve mounted to the panel member controls the flow of water exiting from the shower nozzles.

20 Claims, 4 Drawing Figures

WATER SHOWER UNIT

BACKGROUND OF THE INVENTION

The present invention is concerned with a shower assembly and, more particularly, with a unitized shower assembly formed from plastic members.

The prior art is replete with systems for the conveyance of water to shower heads and the dispersal of water therefrom. These systems all involve either standard metallic or plastic plumbing fixtures employed in a rather commonplace manner. These installations necessitate the work and concomitant expense of plumbers and become what would normally be considered permanent fixtures. Generally these fixtures are, unless covered by cosmetic facades, of rather unsightly or at least purely functional design. This is particularly true in poolside or exterior applications where they are subject to the rigors of outside environmental conditions.

The present invention is involved with an installation which provides both practical advantage and aesthetic qualities. Rather than an installation comprising discrete standard plumbing fixtures, it utilizes a unitized construction formed from plastic members. It is a lightweight, economic and reliable unit combining ease of installation and/or removal with the ability to be incorporated into the aesthetic features of its surroundings.

It is therefore an object of the invention to provide a shower assembly of unitized construction. It is another object of the invention to provide a lightweight, economic and reliable shower unit composed substantially of plastic members. It is another object of the invention to provide a shower unit in which most of the working members are integrally formed therein to comprise a unitized assembly. Yet another object of the invention is to provide a shower unit which may be installed or removed with relative ease and to offer enhanced aesthetic appeal.

SUMMARY OF THE INVENTION

To meet the foregoing objects and to overcome the disadvantages associated with prior art installations, the present invention contemplates shower installation comprising a unitized construction substantially formed of plastic members. A panel member of plastic material has a plurality of shower nozzles integrally formed in a defined area. A plenum chamber is formed about the nozzles and maintains a desired flow of water therethrough. Open channel means are sealingly connected to the panel member and form conduit for conveying water from a supply main to the plenum chamber and a valve is mounted to the panel member, the manipulation of which controls the flow of water exiting from the shower nozzles.

Another aspect of the present invention contemplates a panel member having an open face exposed to the user with upstanding side and bottom walls integrally formed with and extending therefrom. The defined area in which the nozzles are located is contained in an upstanding ramp surface of the panel, the angle of the surface being between approximately 30° and 90° with the plane of the panel. The plenum chamber is formed from an open-faced manifold, the margins of which are sealingly connected to the ramp surface enclosing the defined area in which the nozzles are formed. The open channel means are substantially U-shaped members having radially extending margins for sealing connection to the panel member and which at its terminating ends is sealingly connected to the plenum, the valve means and the water main.

In another aspect of the invention, the panel member ramp surface is inclined at an angle of 45° and the water conduit comprises a first conduit connecting a cold water main to the valve member, a second conduit connecting the hot water main to the valve member, and a third conduit for connecting the valve member to the plenum to convey water of varying temperature thereto.

BRIEF DESCRIPTION OF THE DRAWINGS

Conventional drawing symbols are used throughout the figures and the same number represents the same part in different views. The drawings in combination with the description of the invention are intended as illustrative of applicants' invention and not delimiting of its scope.

DESCRIPTION OF THE PREFERRED EMBODIMENTS

Figure 1:
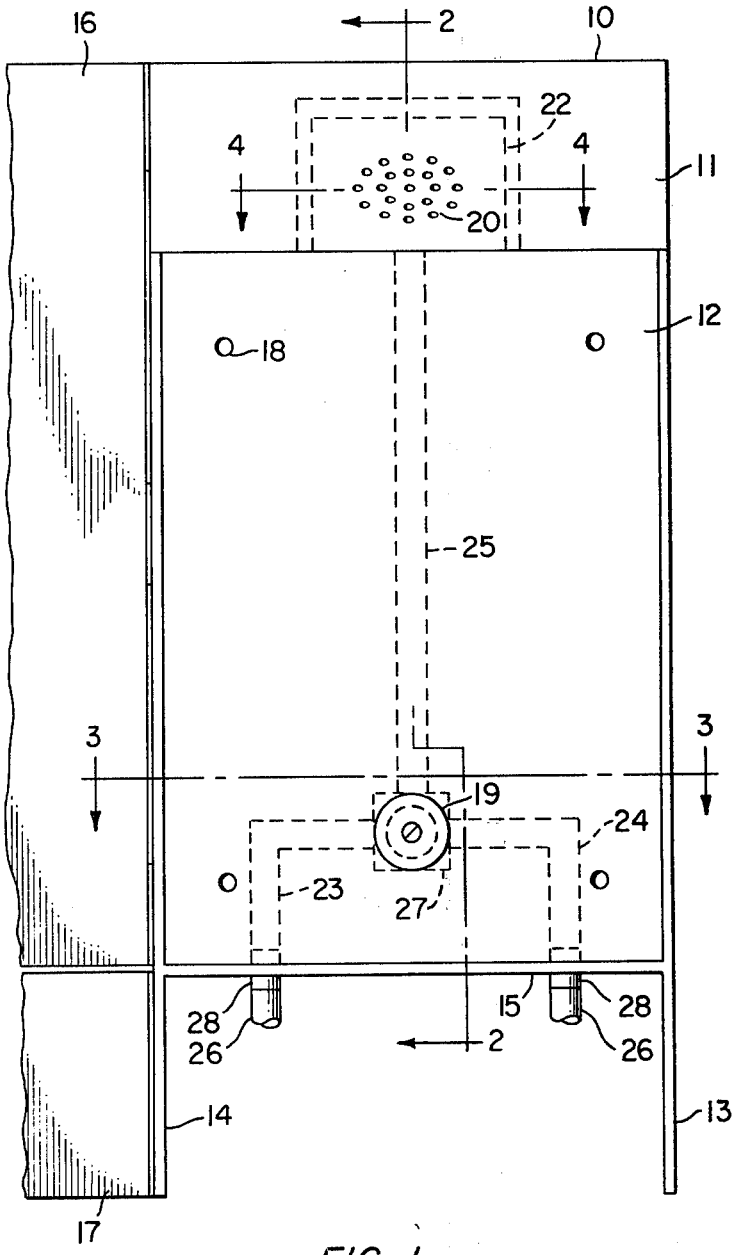
FIG. 1 is a front elevational view of the shower assembly.

FIG. 1 shows unitized shower assembly 10 having panel member 12 through which valve assembly 19 protrudes for adjustment. Ramp surface portion 11 of panel member 12 contains a defined area in which nozzles 20 are formed in a substantially circular pattern for the dispersal of water therefrom. Mounting apertures 18 are shown in a typical arrangement for the affixing of unit 10 to an appropriate mounting surface. Standard mounting fixtures well known to those of ordinary skill in the art and commonly available to the trade may be utilized for this purpose and will vary according to the nature of the material and its geometry to which unit 10 is attached. Mains 26 extend from the central water supply and are affixed to standard couplings 28 which are integrally formed in or molded into unit 10. The remaining exterior features are side walls 13 and 14 and bottom wall 15 perpendicularly upstanding from panel 12. Doors 16 and 17 are hingedly connected to side wall 14 and are used to cover panel member 12 and the access area demarcated by bottom wall 15 respectively. The access area is normally utilized only when making connections to unit 10 or upon its disconnection. Door 16 obviously provided access to unit 10 when in use.

Figure 2:
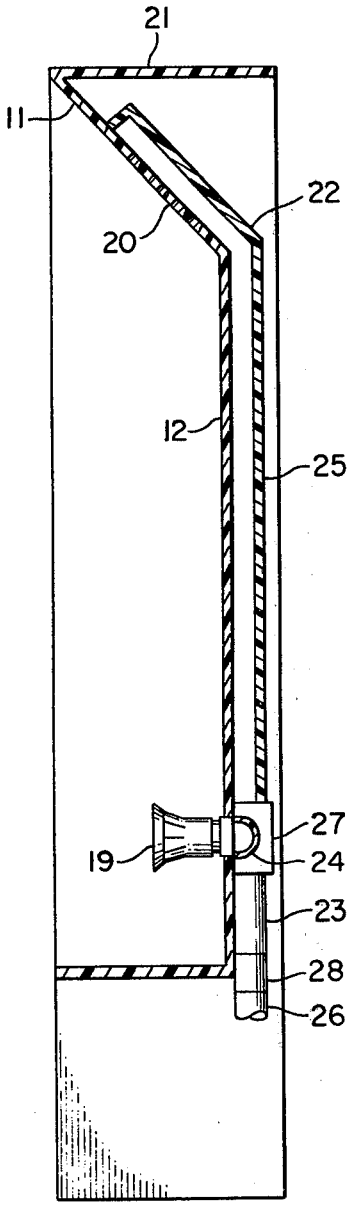
FIG. 2 is a cross-sectional view of the shower assembly of FIG. 1 taken along the line 2—2.

Referring to both FIG. 1 and FIG. 2, shown in outline are first conduit 23, second conduit 24 and third conduit 25. These conduits are formed of open channel means which are sealingly connected to the rear of panel 12 and convey water from main 26 to plenum chamber 22. Conduit 23 connects one incoming main to valve box 27 and conduit 24 connects the other main to valve box 27. As valve 19 is adjusted to the desired flow condition and temperature, water is conveyed through conduit 25 into plenum 22 and thereafter dispersed through nozzles 20.

Figure 4:
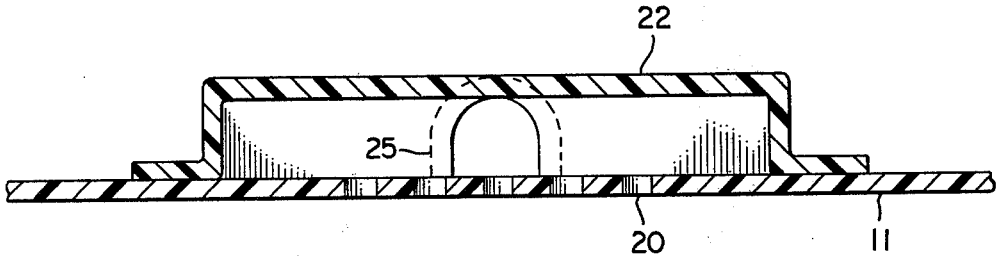
FIG. 4 is an enlarged cross-sectional view of the assembly of FIG. 1 taken along the line 4—4.

Ramp surface 11 can be seen as upwardly extending from the plane of panel member 12 at an angle of approximately 45°. This angle may be varied substantially from approximately 30° to 90° in order to furnish desired shower pattern and/or aesthetic and constructional effect. From the top transverse margin of ramp surface 11, top wall 21 extends in a plane perpendicular to front panel 12 completing with side walls 13 and 14 and bottom wall 15 an open back enclosure for the plenum chamber, the channel means and the valve means. Plenum 22 is formed of plastic and may be considered as forming a substantially rectangular manifold approximately 4 × 4 × ¾ inches deep. The margins of its vertically extending walls are sealingly connected completely about the defined area containing the plurality of nozzles only opening in its lower marginal wall for connection to conduit 25. Referring to FIG. 4, the details of plenum 22 and its sealing connection to conduit 25 and ramp surface 11 are indicated. Flanges extending outwardly from the marginal walls of plenum 22 are provided to form the sealing connection between the manifold and the periphery of ramp surface 11 surrounding nozzles 20. This flange construction, as is well known to those of ordinary skill in the art, may or may not be required depending upon the form of bond or weld utilized. Conduit 25, which can be seen to have a substantially U-shaped open construction, can also be sealingly affixed to the bottom wall of plenum 22 in a number of convenient ways, some of which might require detailed modification of the end geometry, which modifications are well within the skill of those involved in the field.

Figure 3:
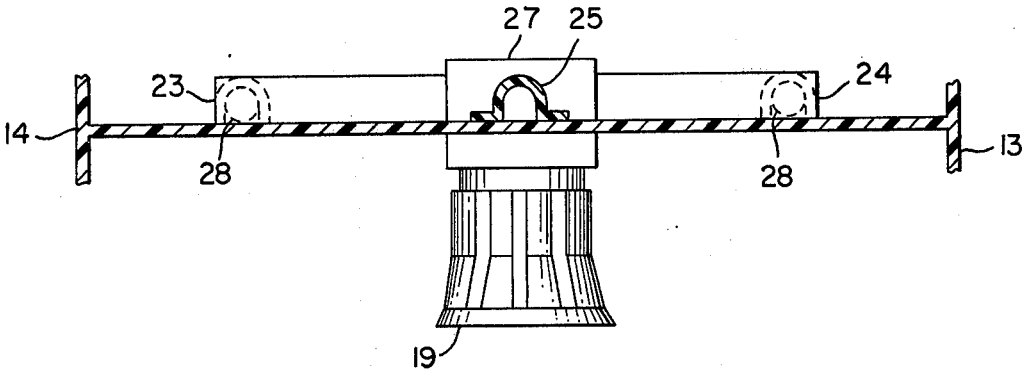
FIG. 3 is an enlarged cross-sectional view of the assembly of FIG. 1 taken along the line 3—3.

Referring to FIG. 3, conduit 25 extends vertically from valve box 27 to which it is sealingly connected along the back of panel 12 terminating in the lower marginal wall of plenum 22. As previously indicated, conduit 25 forming a portion of the open channel means for conducting water from main 26 to plenum 22 is a substantially U-shaped open channel which is sealed along its substantially radially extending margins to the rear of panel member 12 and at its terminal ends to abutting surfaces in the bottom marginal wall of plenum 22 and valve box 27. In similar fashion, conduits 23 and 24 having the same cross-sectional geometry are sealed along their margins to the rear of panel 12 and at their terminal ends to valve box 27 and couplings 28. The conduits, as well as panel member 12, are preferably formed of a thermoplastic material such as polyvinylchloride or equivalent having a wall thickness of approximately one-eighth inch. This thickness, of course, may be varied to provide required constructional performance and to conform to the forming methods utilized. Generally, material and selected wall thickness may be varied to a rather wide degree. Front panel 12 may be molded or thermally formed with appropriate dies depending upon the quantities anticipated and the economics of tooling involved. The conduits may be extruded in straight form and later severed and reconnected to form the desired geometrical pattern or, as in the case of panel 12, may be molded or otherwise thermally formed. The entire channel means are of molded construction and both valve box 27 and couplings 28 may be integrally molded therewith prior to affixing to panel member 12.

In the preferred embodiment of applicant's invention, it is envisioned that the channel means, no matter the subservient method of its formation, will be ultrasonically welded or solvent bonded along its margins to the rear of panel member 12 thereby forming a compact highly reliable unitary construction. In addition to ultrasonic welding techniques which may be employed, equipment for which is readily available, for example, that supplied by The Branson Sonic Power Company of Danbury, Conn., other well-known methods for sealing connection may be employed. Depending upon the material selected, the channel or conduit members may be thermally affixed to panel member 12, seam welded to panel 12 or connected by materials which are predisposed on panel 12 and the conduits and which are afterwards energetically activated.

Valve 19 is preferably a single control mixing valve similar to the type manufactured by The Bradley Corporation, Models 611, 612 and 621, with the exterior housing removed and the valve cartridge adapted to connect with valve box 27. The adaptations necessary to the use of such valve are well within the skill of those involved in the valve field and results from the practice of common engineering knowledge. The periphery of valve box 27 at the points of juncture with conduits 23, 24 and 25 and panel member 12 is sealingly welded or connected to panel member 12 by the same method and preferably at the same time as the other welding or sealing operations are performed.

Hence, applicants have provided a shower assembly of unitized construction meeting the objects as heretofore set forth and overcoming the problems of prior art assemblies. Applicants have produced a lightweight, economical, highly reliable shower unit employing features heretofore unknown. It is intended that the description of this invention and the preferred embodiment be illustrative of applicant's invention and that those variations obvious to one of ordinary skill in the art are within its ambit.

What is claimed is:

1. A shower unit comprising:

a panel member formed of plastic material having an upwardly extending ramp surface along a top margin thereof with a plurality of shower nozzles integrally formed in a defined area of the ramp surface;

a plenum assembly sealingly connected about the periphery of the defined area communicating with the nozzles;

open channel means sealingly connected along its exterior margins to the panel member forming a conduit from a water supply main to the plenum; and a valve sealingly connected and mounted to the panel member interposed in the channel means for controlling the flow of water exiting from the shower nozzles.

2. The shower unit of claim 1 wherein the panel member is an integrally formed open-faced panel having side and bottom walls and an upwardly extending ramp surface along its top margin containing the defined area in which the nozzles are formed.

3. The shower unit of claim 2 wherein the plenum is a plastic integrally formed open-faced chamber of substantially rectangular form having upstanding marginal walls, the walls being sealingly connected to the ramp surface and having an opening therein for connecting to the channel means.

4. The shower unit of claim 3 wherein the ramp surface is disposed at an angle of approximately between 30° and 90° to the plane of the panel.

5. The shower unit of claim 4 wherein the channel means comprises open substantially U-shaped conduits sealingly connected along their margins to the panel.

6. The shower unit of claim 5 wherein a bottom wall member upwardly depends from the panel, dividing the panel into a first section in which the valve and shower nozzles are positioned and a second section wherein the water supply mains are positioned, and the second section is covered by a removable access member.

7. The shower unit of claim 6 wherein the first section is covered by another removable access member.

8. The shower unit of claim 7 wherein the removable access members are doors hinged to the side wall.

9. The shower unit of claim 8 wherein the doors are hinged to the side wall by integrally molded webs.

10. The shower unit of claim 2 wherein the ramp surface is disposed at an angle of approximately 45° to the plane of the panel.

11. The shower unit of claim 10 wherein the open channel means includes a first channel member sealingly connected to a bottom margin of the plenum and an outlet orifice of the valve means, a second channel member sealingly connected to one main and to a first inlet orifice of the valve means, and a third channel member sealingly connected to the other main and a second inlet orifice of the valve means.

12. The shower unit of claim 11 wherein the valve means comprises a mixing valve cartridge sealingly connected within a valve housing, the valve housing being sealingly connected along its outer margins to the panel member and having an outlet orifice connecting to the first channel member, a first inlet orifice for connecting to the second channel member and a third inlet orifice for connecting to the third channel member.

13. The shower unit of claim 12 wherein the first, second and third channel members and the valve housing are integrally formed.

14. The shower unit of claim 13 wherein the channel members are substantially U-shaped having thicknesses approximately between 1/16 and 3/16 inch, and the panel member has a wall thickness greater than approximately ⅛ inch.

15. The shower unit of claim 12 wherein the channel members and the valve housing are sealed to the panel member by ultrasonic welding.

16. The shower unit of claim 12 wherein the channel members and valve housing are solvent bonded.

17. The shower unit of claim 13 wherein the panel, the channel members and the valve housing are formed of thermoplastic polyvinylchloride.

18. The shower unit of claim 12 wherein the U-shaped channel members and the valve member have flanges formed along their margins for sealing connection to the panel member.

19. The shower unit of claim 12 wherein the second and third channel members are sealingly connected to fittings for connection to the water supply main.

20. The shower unit of claim 19 wherein the fittings are quick disconnect fittings.

* * * * *